US007000347B2

(12) United States Patent
Roskin

(10) Patent No.: US 7,000,347 B2
(45) Date of Patent: Feb. 21, 2006

(54) DEVICE AND METHOD FOR ADAPTING A CONTAINER FOR USE IN A FLORAL ARRANGEMENT

(76) Inventor: Linda Roskin, 7 Liberte La., Wayne, PA (US) 19087

( * ) Notice: Subject to any disclaimer, the term of this patent is extended or adjusted under 35 U.S.C. 154(b) by 422 days.

(21) Appl. No.: 09/874,031

(22) Filed: Jun. 6, 2001

(65) Prior Publication Data

US 2002/0184818 A1 Dec. 12, 2002

(51) Int. Cl.

| | |
|---|---|
| ***A01G 5/00*** | (2006.01) |
| ***A47G 7/07*** | (2006.01) |
| ***B65D 85/50*** | (2006.01) |
| ***B65D 1/00*** | (2006.01) |
| ***B65D 1/40*** | (2006.01) |

(52) U.S. Cl. ..... 47/41.11; 47/41.01; 47/41.12; 47/84; 206/423; 220/908; 220/908.1; 220/731; 220/730; 220/713; 220/719; 220/700; 220/212; 215/317

(58) Field of Classification Search ..... 47/41.11, 47/41.01, 41.1, 41.12, 41.13, 41.14, 41.15, 47/31.1, 85, 84, 67; 248/27.8; 215/200, 215/317; D9/435; 220/200, 908, 731, 908.1, 220/730, 713, 719, 700, 701; 206/816, 423; 150/154; A47G 7/07

See application file for complete search history.

(56) References Cited

U.S. PATENT DOCUMENTS

| | | | | | |
|---|---|---|---|---|---|
| 1,379,340 | A | * | 5/1921 | Hegamin | |
| 2,064,411 | A | * | 12/1936 | Brandstein | 215/321 |
| 2,080,108 | A | * | 5/1937 | Brandstein | |
| 2,876,587 | A | * | 3/1959 | Saks et al. | |
| 2,900,760 | A | * | 8/1959 | Tupper | 47/41.11 |
| 3,170,875 | A | * | 2/1965 | Swett | |
| 3,447,262 | A | * | 6/1969 | Uhl | |
| 3,768,685 | A | * | 10/1973 | Eckman | 215/100 R |
| 3,862,614 | A | * | 1/1975 | Kovac | 215/317 |
| 3,883,990 | A | * | 5/1975 | Stidolph | 47/41.01 |
| 4,418,496 | A | * | 12/1983 | Koistinen | 47/41.12 |
| 4,901,881 | A | * | 2/1990 | McElroy | 220/287 |
| 5,036,994 | A | * | 8/1991 | McElroy | 220/212 |
| 5,142,820 | A | * | 9/1992 | Aquino | 47/41.12 |
| 5,758,452 | A | * | 6/1998 | Matteucci et al. | 47/41.01 |
| 5,848,493 | A | * | 12/1998 | Gasper | 47/41.15 |
| 6,189,261 | B1 | * | 2/2001 | Helgeson | 47/41.11 |

FOREIGN PATENT DOCUMENTS

| | | | |
|---|---|---|---|
| EP | 0182453 | * | 7/1985 |
| JP | 404190719 A | * | 7/1992 |

* cited by examiner

*Primary Examiner*—Peter M. Poon
*Assistant Examiner*—Andrea M. Valenti
(74) *Attorney, Agent, or Firm*—LaMorte & Associates

(57) ABSTRACT

A device and method for preparing a vase or other container to receive a floral arrangement. The device includes a grid cover that is placed around the open end of a vase or similar container. The grid cover has a flat top surface and a peripheral wall that extends downwardly from the edge of the top surface. The grid cover is made of elastomeric material and is initially smaller than the open top of the vase. The grid cover is stretched over the open top of the vase, wherein the peripheral wall of the grid cover passes over the edge of the vase's open top and retains the stretched grid cover element in place. A plurality of openings are distributed throughout the top surface of the grid cover. As the grid cover is stretched over the top of a vase, the openings become positioned across the open top of the vase.

17 Claims, 4 Drawing Sheets

DEVICE AND METHOD FOR ADAPTING A CONTAINER FOR USE IN A FLORAL ARRANGEMENT

BACKGROUND OF THE INVENTION

1. Field of the Invention

In general, the present invention relates to devices and methods that are used to divide a container into sections so that the container can better be used to hold a designed floral arrangement. More particularly, the present invention relates to partitioned covers for vases, and other traditional flower holding containers, that assist in the formation of a floral design.

2. Description of the Prior Art

Cut flowers and greens have been used for decorations for many centuries. As is well known by most people, cut flowers and greens remain alive and beautiful for a significant period of time if they are placed in water while being displayed. As such, most all cut flowers are typically displayed in a vase or some other container that is designed to hold both the flowers and a volume of water that surrounds the cut stems of the flowers.

Over the years, the art of floral design has developed into a sophisticated art form. In floral design, flowers and greens are placed in arrangements according to their color, size, flower type and shape. However, in order to create an aesthetically pleasing arrangement, flowers and greens must be set into a designed arrangement so that both the flowers and greens remain erect, oriented and properly spaced. Flowers and greens are not just randomly combined and displayed. Rather, great care is taken to place each flower and each green into a particular position that enhances the beauty of the overall display.

Most often, cut flowers and greens are placed in vases. A vase is a container with an open top. Vases come in a large variety of sizes shapes and designs. However, in most cases, the vase presents a single top opening into which flowers and greens are placed. When arranging flowers in a vase, little holds each flower in place other than the tangle of the cut stems in the confined space of the vase. Consequently, flowers and green often move out of position in a vase, especially if the vase is moved or the flowers are inadvertently touched.

To help prevent arranged flowers from moving out of their designed placement, many different types of devices have been developed. One such item is open cell foam. Open cell foam is a soft foam material that retains water within its structure. Cut stems from flowers and greens can be forced into the foam, wherein the foam holds the stems in place. Many professional flower arrangers place segments of open cell foam into vases. The flowers are then inserted into the foam as the flowers are set in the vase. As such, the foam holds the flowers in a set position throughout the life of the flowers.

Open cell foam is bulky and must be cut to size. As such, it is hard to store and labor intensive to use. As cut flowers and greens are inserted into a segment of open cell foam, the foam becomes damaged. As a consequence, most people throw the open cell foam away with the flowers after the flowers die. This requires that a new segment of open cell foam be cut to size and inserted into a vase each time a new set of cut flowers is held in that vase.

In the prior art, grids are also used to hold flowers in place in a vase or similar container. Grids are open framework structures that are placed over the open top of a vase. The framework defines evenly spaced openings arranged in a grid pattern. Cut flowers and greens are then placed into the vase through the open spaces, wherein the grid holds the flowers apart in pattern in which they were inserted through the grid.

The problem associated with prior art grids is that they are rigid structures that are made to a specific size. Vases and other flower containers come in a wide variety of shapes, styles and sizes. Accordingly, when a grid is placed across the top of a vase, the grid overlaps the vase at a variety of points. This often detracts from the aesthetic value of the floral arrangement. As such, a floral designer must either have a large selection of grids to fit many different types of vases, or the floral designer must accept the visually undesirable overlap of the grid.

Another type of flower arrangement accessory is floral tape. Floral tape is a thin waterproof tape that has a high tensile strength. The tape is cut into strips and is placed across the open top of a vase to divide the vase into different compartments. Flowers are then placed into the openings between the strips of tape.

Although floral tape can be used on vases of any size and shape, the floral tape is difficult and time consuming to install. Furthermore, the tape must be replaced after one use. Thus it is expensive to use by people to arrange flowers regularly.

A need therefore exists for a device and method of retaining a floral design pattern in a vase without having to cut open cell foam, accepting poorly fitting grids or wasting time and money on tape. This need is met by the present invention as described and claimed below.

SUMMARY OF THE INVENTION

The present invention is a device and method for preparing a vase or other container to receive a floral arrangement. The device includes a grid cover that is placed around the open end of a vase or similar container. The grid cover has a flat top surface and a peripheral wall that extends downwardly from the edge of the top surface. The grid cover is made of elastomeric material and is initially smaller than the open top of the vase. The grid cover is stretched over the open top of the vase, wherein the peripheral wall of the grid cover passes over the edges of the vase's open top and retains the stretched grid cover in place.

A plurality of openings are distributed throughout the top surface of the grid cover. As the grid cover is stretched over the top of a vase, the openings become positioned across the open top of the vase. Elements of a floral arrangement are placed into the vase through the available openings. The openings in the grid cover retain the elements of the floral arrangement in a set pattern, thereby preventing the floral arrangement from changing out of its originally designed configuration.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device and method can be used to orient any elongated object within a receptacle, such as paint brushes in a can, the present invention is particularly well suited for retaining cut flowers in a vase. Accordingly, the present invention is described in an application where it is used to hold flowers in a vase in order to set forth the best mode contemplated for the invention.

Figure 1:
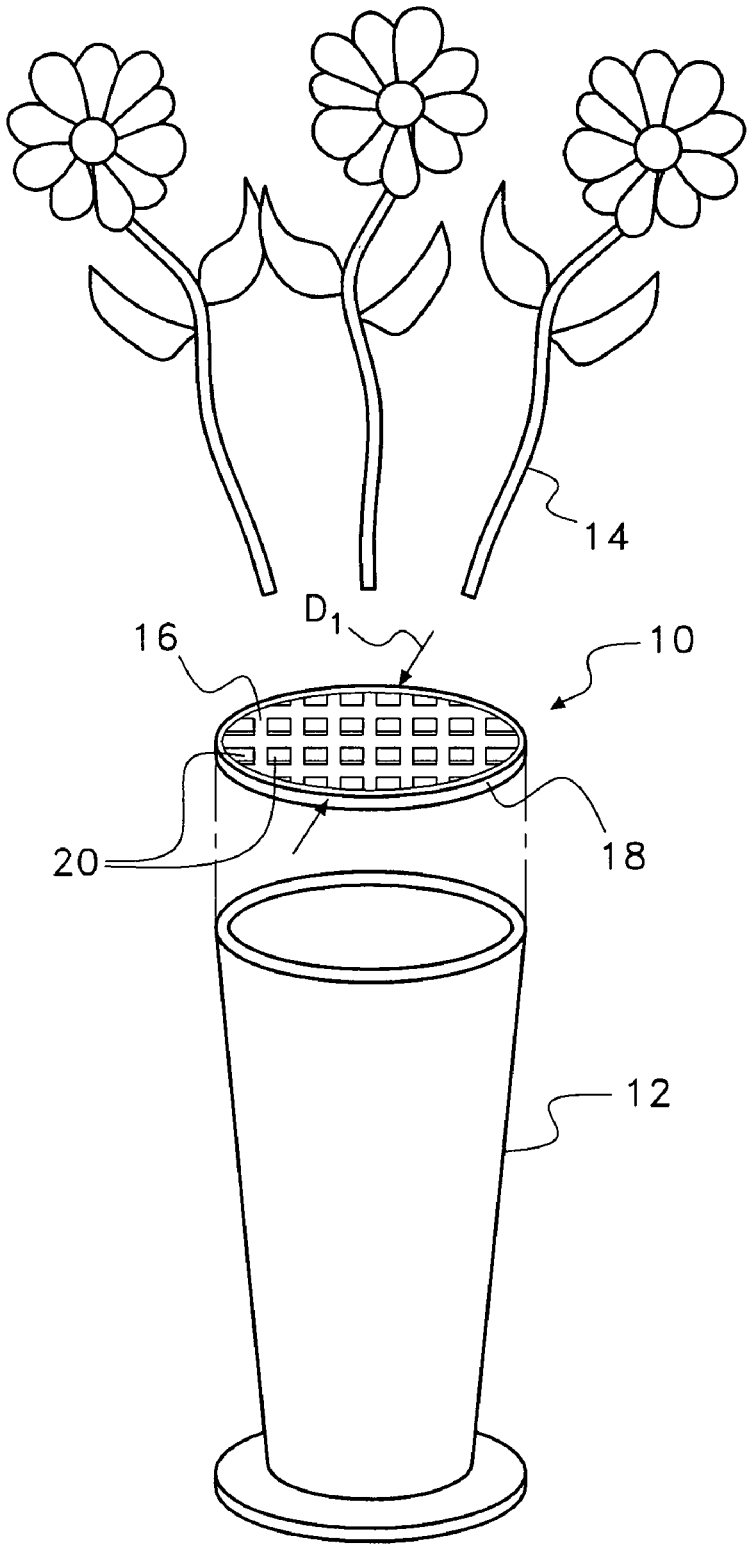
FIG. 1 is perspective view of an exemplary embodiment of the present invention grid cover shown in conjunction with a vase and elements of a floral arrangement.

Referring to FIG. 1, an embodiment of the present invention grid cover 10 is shown in conjunction with a vase 12 and a plurality of cut flowers 14. The vase 12 is of a traditional construction, having a circular open top. However, it should be understood that vases with non-circular open tops can also be used.

The present invention is a grid cover 10 that engages the vase 12 over its open top end. The grid cover 10 is made of elastomeric material and can therefore be stretched into many different configurations. The grid cover 10 contains a top surface 16 and a peripheral wall 18 that extends downwardly from the edge of the top surface 16. However, the top surface 16 is not solid. Rather, the top surface 16 is formed in a grid pattern, where multiple open spaces 20 are spaced evenly across the top surface 16. Each open space 20 extends completely through the top surface 16 of the grid cover 10 and is unobstructed.

The grid cover 10 is made from thin elastomeric material that has a high degree of elasticity. In the shown embodiment, the grid cover 10 is circular in shape. However, other geometrically symmetric shapes, such as polygonal shapes can also be used. In the shown illustration, the grid cover 10 has a predetermined outside diameter D1. The diameter D1 of the grid cover 10 is preferably smaller than the maximum distance between points on the open top of the vase 12, Accordingly, in order to have the grid cover 10 fit over the open top of the vase 12, the grid cover 10 must be stretched to a size larger than the open top of the vase 12.

As the grid cover 10 is stretched, a contracting bias is experienced in the material of the grid cover 10. Accordingly, when the peripheral wall 18 of the grid cover 10 is extended over the open top of the vase 12, the contracting bias in the material of the grid cover 10 causes the grid cover 10 to conform to the shape of the open top of the vase 12. If the vase 12 has an open top edge that is not circular, the peripheral wall 18 of the grid cover 10 will conform to the shape of the edge of the vase. Accordingly, a single grid device can be used to cover the open top of a variety of different vases, regardless of the size, shape or configuration of the vase. This point is better illustrated by referring to FIG. 2.

Figure 2:
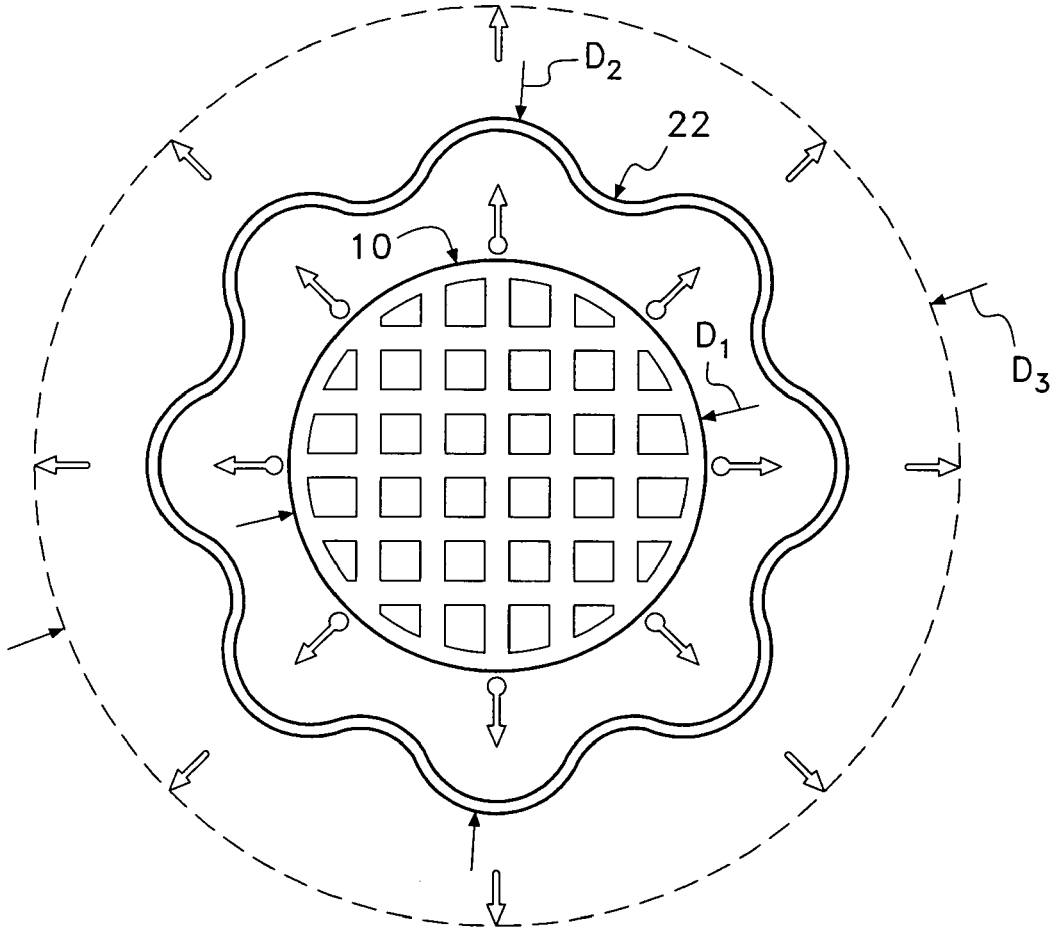
FIG. 2 is a top view of the present invention grid cover shown with a vase having a convoluted shape.

In FIG. 2, the top edge of a vase 22 is shown. The vase 22 does not have a perfectly circular rim, such as was shown in FIG. 1. Rather, the vase 22 has a convoluted top edge that is not symmetrically formed. The top edge of the vase 22 has a maximum diameter D2 at its widest point. The grid cover 10 has an unstretched diameter D1 that is smaller than the maximum diameter D2 of the top edge of the vase 22. A grid cover 10 is selected that can be stretched to a diameter that is larger than the maximum diameter D2 of the top edge of the vase 22. In the shown illustration, the grid cover 10 can be stretched to a maximum diameter D3, which is shown with a hidden line. The maximum diameter D3 of the stretched grid cover 10 is larger than the maximum diameter D2 of the top edge of the vase 22. As such, it will be understood that the grid cover 10 can be stretched over the top edge of the vase 22.

Figure 3:
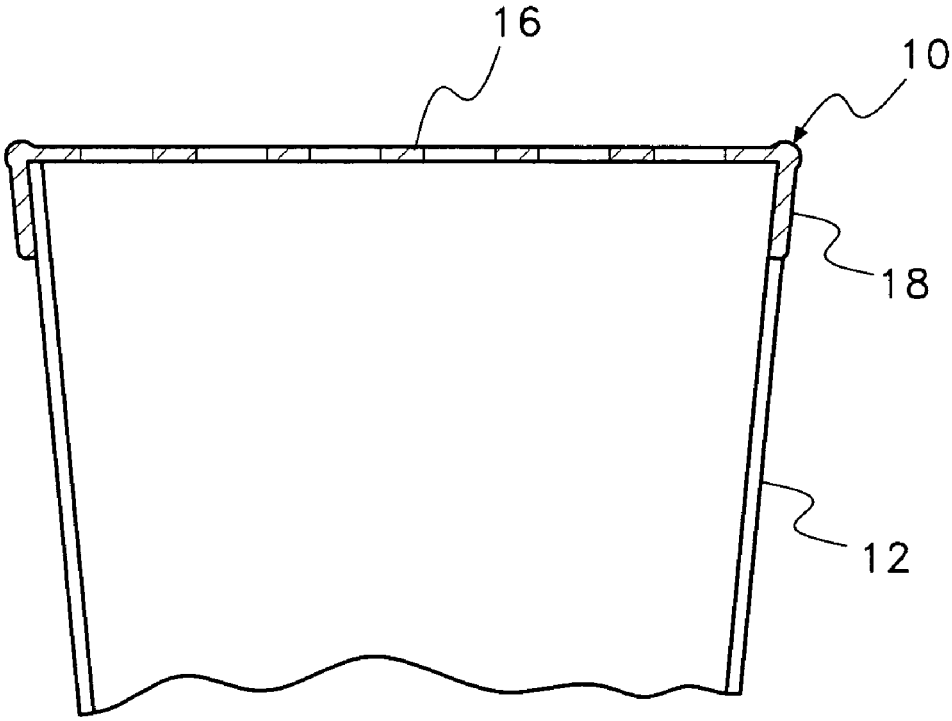
FIG. 3 is a fragmented cross-sectional view of the present invention grid cover engaging the top edge of a vase.

Referring now to FIG. 3, the grid cover 10 is shown covering the vase 12 previously illustrated in FIG. 1. From FIG. 3, it can be seen that once the grid cover 10 is stretched over the top edge of a vase 12, the peripheral wall 18 of the grid cover 10 extends down the side of the vase 12. As the peripheral wall 18 extends down the side of the vase 12, the elastomeric material of the peripheral wall 18 conforms to the shape of the vase 12 near its top edge. The result is a grid cover 10 that attaches the vase without over-extending the vase 12. Consequently, one grid cover can be attached to a large variety of vases.

As has been previously described, the grid cover 10 is made of elastomeric material. The selected material has a high degree of elasticity and is hydrophobic. The grid cover 10 can be manufactured in a variety of colors. For example, the grid cover 10 can be green or have a camouflage pattern. In this manner, the grid cover 10 would not be highly noticeable when positioned under an arrangement of cut flowers and greens. Alternatively, the grid cover 10 can be translucent. In this manner, the vase 12 would appear to have no covering and the grid cover 10 would not detract from the color scheme of the vase or the flower arrangement in the vase 12.

It is understood that not all vases have circular or quasi-circular top edges. Rather, many vases have a top edge that follows a polygonal shape, where sharp edges exist at the salient points along the polygonal path. The present invention grid cover can be manufactured for use on such vases.

Figure 4:
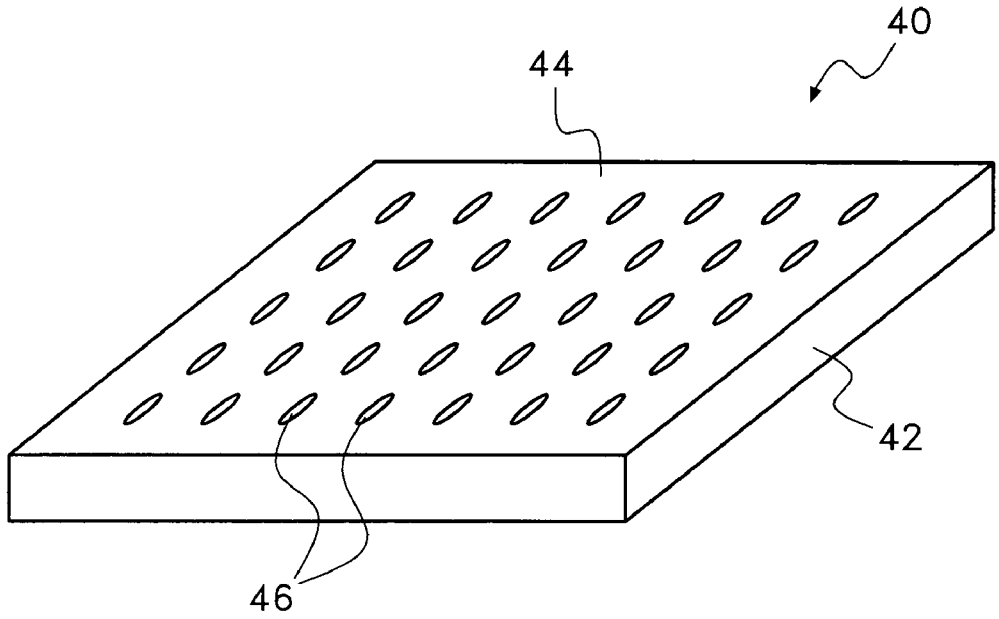
FIG. 4 is a perspective view of an alternate embodiment of the present invention grid cover.

Referring to FIG. 4, a grid cover 40 is shown. In this embodiment, the grid cover 40 has a peripheral wall 42 that is formed as a polygon. Consequently, the periphery of the top surface 44 of the grid cover 40 is also shaped as a polygon. In the shown illustration, the polygon is a square. However, any other polygonal shape, such as a triangle, pentagon or the like, can also be used. A grid cover 40 with a polygonal shape is for use on a vase having a top edge with a polygonal shape. For instance, suppose a vase is provided that has a top edge that is essentially square in shape. If this were the case, a grid cover that is square in shape would fit on this vase better than a grid cover that is circular. Although a circular grid cover could be used, a circular grid cover may buckle around the top edge of the vase. Using a grid cover with a polygonal shape similar to that of the vase, eliminates buckling and provides for a more precise and neat fit.

In the embodiment of FIG. 4, the openings in the top surface 44 of the grid cover are formed in a manner that is different from what has been previously described. In the embodiment of FIG. 4, slits 46 are formed in the top surface 44 of the grid cover 40. The slits 46 are closed when the grid cover 40 is not stretched. However, when the grid cover 40 is stretched over a larger vase, the stretching of the grid cover 40 causes the slits 46 to pucker, thereby creating enlarged openings through which the stems of cut flowers and greens can be placed.

It will be understood that the embodiments of the present invention device and method described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. An assembly, comprising:

a container having an open top end with a predetermined maximum width;

an elastomeric cover element for covering said open top end, said cover element having an unstretched width that is smaller than said maximum width of said open top end wherein said cover element must be elastically stretched to a stretched width greater than said maximum width of said open top end to cover said open top end; and a grid pattern of openings defined in said cover element, said grid pattern having multiple rows and multiple columns, wherein multiple openings are arranged in each of said rows and each of said columns.

2. The assembly according to claim 1, wherein said open top end of said container is not symmetrical and said cover element conforms to the open top end of the container when engaged with the open top of the container.

3. The assembly according to claim 1, wherein said cover element has a planar top surface and a peripheral wall that extends downwardly from said planar top surface.

4. The assembly according to claim 3, wherein said grid pattern is on said planar top surface.

5. The assembly according to claim 3, wherein said openings are slots that enlarge when said cover element is stretched.

6. The assembly according to claim 1, wherein said cover element is translucent.

7. The assembly according to claim 1, wherein said cover element has a circular peripheral shape.

8. The assembly according to claim 1, wherein said cover element has a polygonal peripheral shape.

9. A method of preparing a vase for a floral arrangement, wherein the vase has an open top with a maximum width at least one point, said method comprising the steps of:

providing an elastomeric cover, containing a plurality of openings that are arranged in a grid pattern of multiple rows and multiple columns, wherein said elastomeric cover has a width that is less than said maximum width of said vase, and wherein multiple openings are present in each of said rows and said columns;

stretching said elastomeric cover over said open top of said vase, wherein said width of said elastomeric cover elastically increases to a width greater than that of said vase and engages said vase around said open top.

10. The method according to claim 9, wherein said cover has a planar top surface and a peripheral wall that extends downwardly from said planar top surface, wherein said grid pattern is on said planar top surface.

11. The method according to claim 9, further including the step of inserting elements of a floral arrangement through said plurality of openings and into said vase.

12. A floral arrangement cover for a vase, wherein the vase has an open top, said cover comprising:

an elastic planar top surface in which are defined a plurality of openings that are arranged in a grid pattern of multiple rows and multiple columns, wherein multiple openings are disposed within each of said rows and said columns;

an elastic peripheral wall that extends downwardly from said planar top surface, said elastic planar top and said elastic peripheral wall being elastically stretchable to a stretched size having an unstretched width that is smaller than a maximum width of the open top of the vase, where said peripheral wall stretches to receive the open top of the vase therein and said elastic planar top spans the open top of the vase, wherein said peripheral wall engages the vase around the open top by contracting around the open top.

13. The device according to claim 12, wherein said plurality of openings are symmetrically disposed throughout said planar top surface.

14. The device according to claim 12, wherein said plurality of openings are slots that enlarge when said planar top surface is stretched.

15. The device according to claim 12, wherein said planar top surface is translucent.

16. The device according to claim 12, wherein said planar top surface has a circular peripheral shape.

17. The device according to claim 12, wherein said planar top surface has a polygonal peripheral shape.

* * * * *